US007446762B2

(12) United States Patent
Hsieh et al.

(10) Patent No.: US 7,446,762 B2
(45) Date of Patent: Nov. 4, 2008

(54) SYSTEM AND METHOD FOR AVOIDING EYE AND BODILY INJURY FROM USING A DISPLAY DEVICE

(75) Inventors: Kuan-Hong Hsieh, Tu-Cheng (TW); Xiao-Guang Li, Shenzhen (CN)

(73) Assignees: Hong Fu Jin Precision Industry (Shenzhen) Co., Ltd., Bao-an District, Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 520 days.

(21) Appl. No.: 11/075,132

(22) Filed: Mar. 8, 2005

(65) Prior Publication Data

US 2005/0206584 A1 Sep. 22, 2005

(30) Foreign Application Priority Data

Mar. 16, 2004 (TW) ..... 93106917 A

(51) Int. Cl.
*G09G 5/00* (2006.01)

(52) U.S. Cl. ..... 345/204; 351/203

(58) Field of Classification Search ..... 345/589, 345/600, 204; 351/203
See application file for complete search history.

(56) References Cited

U.S. PATENT DOCUMENTS 6,075,525 A * 6/2000 Hsieh ..... 345/589
6,091,399 A * 7/2000 Sumiyoshi et al. ..... 345/600
2002/0008696 A1* 1/2002 Wagner ..... 345/204

FOREIGN PATENT DOCUMENTS

CN 1233910 A 11/1999

OTHER PUBLICATIONS www.webweaver.nu, free clipart eyes, Aug. 8, 2002, www.webweaver.nu, p. 1.*

* cited by examiner

*Primary Examiner*—Alexander Eisen
*Assistant Examiner*—Christopher E Leiby
(74) *Attorney, Agent, or Firm*—Morris, Manning & Martin LLP; Tim Tingkang Xia

(57) ABSTRACT

A system for avoiding eye and bodily injury from using a display device comprises: a storage unit for storing a first program and a second program; a timer for respectively measuring corresponding running time of the programs; a counter for counting a continuous running count of the first program; a control unit for running the programs stored in the storage unit and outputting a control signal; an OSD (On Screen Display) component for receiving the control signal, and outputting OSD data such as a series of dynamic icons for reminding users to blink, and pattern data for reminding users to take exercises; and a display unit for receiving the OSD data to display the dynamic icons, and the pattern data to show a comfort display. A corresponding method is also provided.

20 Claims, 4 Drawing Sheets

SYSTEM AND METHOD FOR AVOIDING EYE AND BODILY INJURY FROM USING A DISPLAY DEVICE

BACKGROUND OF THE INVENTION

1. Field of the Invention

The present invention relates to a system and method for protecting health of a user during operating a display device, and more specially for avoiding eye and bodily injury from using a display device.

2. Prior Art

In the new era of digital data and Internet, computer plays more and more important role in our life, work and entertainment, it becomes one of the hi-tech products on which we depend greatly in our daily life.

However, according to recent medical research, people suffer discomforts from long-term computer usage. Among all computer repetitive stress injuries (CRSI), injuries the most been often complained of are Computer Vision Syndrome (CVS) and Carpal Tunnel Syndrome (CTS) caused by long-term concentrating on screen of a display device, repeated keystrokes and long periods of clutching and dragging with mouse. Generally speaking, computer users who use computer continuously over two hours per day are prone to comprising CVS. Reduced blinking frequency caused by long-term concentrating on the screen will make the moisture of the eyes vaporize rapidly and let people feel dryness on eyes, and further induce chronic conjunctivitis and xerophthalmia. The flickering screen and reflex also aggravate eyestrain even further, so poor eyesight gets worse. The users often claim eyestrain, headache and tiredness. The CTS occurs from repeated physical movements doing damage to tendon, nerves, muscles and other soft body tissues of hands. The thousands of repeated keystrokes and long periods of clutching and dragging with mouse slowly accumulate damage to the wrists and cause numbness and pain.

Those who suffer from the CVS and the CTS should run for proper medical therapy immediately, otherwise, they would suffer permanent injury or painful sequel. However, compared with all the time and money it might involve during the therapy, the CVS and the CTS are far easier to prevent than to cure once contracted. Usually doctors suggest computer users to shorten the time to use computer and take regular break and hereby prevent the CVS and the CTS.

There are lots of systems and methods for preventing computer repetitive stress injuries. For instance, an U.S. Pat. No. 6,075,525 issued on Jun. 13, 2000 and entitled "Method for Preventing the Injury of Eyesight during Operating a Device with a Display" discloses a method for preventing the injury of eyesight during operating a device with a display. The method comprises steps of: (A) presetting a value of a second interval (T2); (B) accumulating the operating time of said device; (C) if the accumulating time reached the value of the second interval (T2), a menu showing on said display to remind user to relax eyes, if the user chooses to relax eyes from the second pattern, executing step (D), otherwise executing step (E); (D) displaying a moving pattern(s) which can relax user's eyes, after said moving pattern being terminated, the process returns to said step (A); and (E) decreasing the value of the second interval (T2) and returning to said step (A). However, the invention is built upon the operating system which is a platform the invention runs on. Therefore, when the operating system encounters malfunction and not work normally, the invention also does not work. In addition, the invention does not mention to remind user to take exercises for relaxing body.

Accordingly, what is needed is a system and method which can prevent a user from eye and bodily injury caused by long-term concentrating on screen of the display device and is independent of the operating system.

SUMMARY OF THE INVENTION

It is therefore an object of the present invention is to provide a system for avoiding eye and bodily injury from using a display device.

Another object of the present invention is to provide a method for avoiding eye and bodily injury from using a display device.

To accomplish the main object, a system for avoiding eye and bodily injury from using a display device in accordance with a preferred embodiment of the present invention comprises: a storage unit for storing a first program and a second program; a timer for respectively measuring corresponding running times of the first and second programs; a counter for counting a running count of successively running the first program; a control unit for running the first and second programs stored in the storage unit and outputting control signals; an OSD (On Screen Display) component for receiving the control signals and outputting OSD data; and a display unit for displaying the OSD data in a first and second modes corresponding to the first and second programs.

To achieve the other object, a method for avoiding eye and bodily injury from using a display device in accordance with a preferred embodiment of the present invention comprises the steps of: (a) presetting a value of an interval and a number; (b) setting a waiting time for running a first program, a running time and a running count of the first program, and a running time of a second program as "0;" (c) measuring the waiting time; (d) if the waiting time has reached a preset threshold value of the interval, running the first program to display a series of dynamic icons for reminding a user to relax his/her eyes; (e) after the first program being terminated, increasing the running count once; (f) if the running count has not reached a preset threshold value of the number, going to step (c), otherwise, running the second program to display a comfort display for reminding the user to relax his/her body; and (g) after the second program being terminated, going to step (b).

Other objects, advantages and novel features of the present invention will be drawn from the following detailed description with reference to the attached drawings, in which:

DETAILED DESCRIPTION OF THE PREFERRED EMBODIMENT

Figure 1:
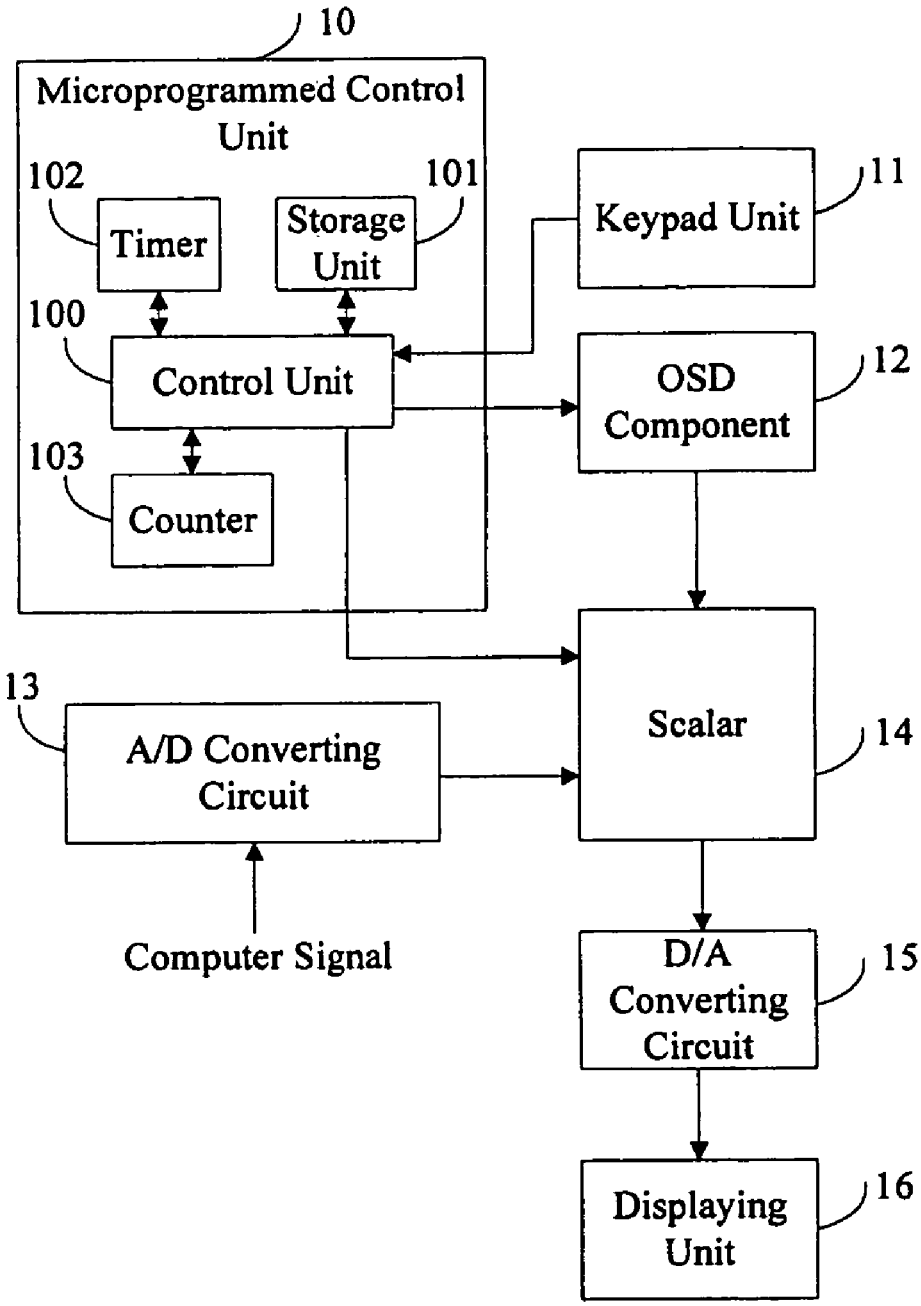
FIG. 1 is a block diagram of hardware infrastructure of a system for avoiding eye and bodily injury from using a display device in accordance with the preferred embodiment of the present invention.

FIG. 1 is a block diagram of hardware infrastructure of a system for avoiding eye and bodily injury from using a display device (hereinafter, "the system") in accordance with the preferred embodiment of the present invention. The system comprises a microprogrammed control unit (MCU) 10, a keypad unit 11, an on screen display (OSD) component 12, an analog/digital (A/D) converting circuit 13, a scalar 14, a digital/analog (D/A) converting circuit 15, and a displaying unit 16. The MCU 10 comprises a control unit 100, a storage unit 101, a timer 102, and a counter 103.

The storage unit 101 stores a first program and a second program applied to implement the present invention. The first program is run to display a series of blinking icons to remind the user to blink their eyes. The second program is run to display a comfort display to remind the user to take exercises. The timer 102 respectively measures corresponding running times of the two programs. The counter 103 counts a continuous running count of the first program.

The keypad unit 11 generates a command signal in response to operations of the user, and outputs the command signal to the control unit 100. The control unit 100 runs the programs and outputs a control signal in accordance with the command signal. The OSD component 12 receives the control signal, and outputs OSD data such as a series of blinking icons for reminding users to blink and pattern data for reminding users to take exercises. The A/D converting circuit 13 converts analog signals (i.e., computer signals) into digital signals. The scalar 14 overlays image signals from a computer with the OSD data to generate resultant signals. The D/A converting circuit 15 converts the resultant signals into corresponding analog signals. The displaying unit 16 displays the analog signals received from the D/A converting circuit 15.

Figure 2:
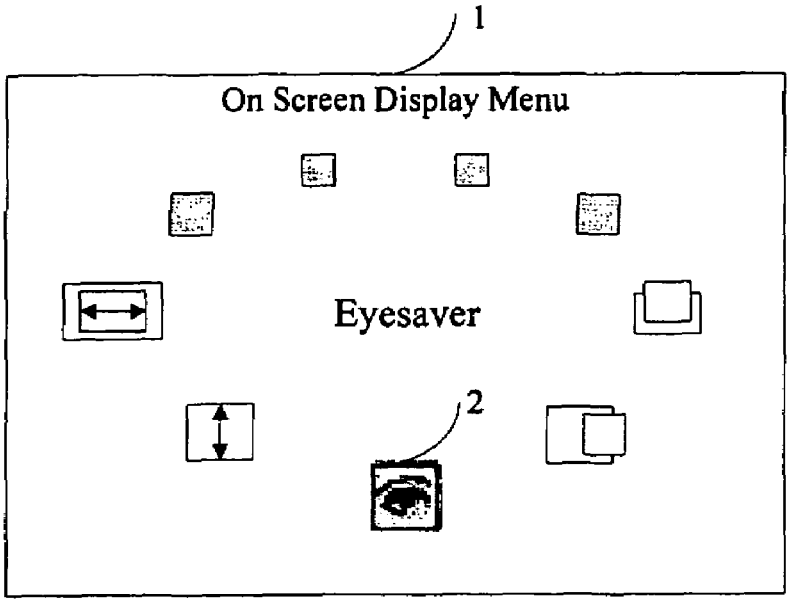
FIG. 2 schematically illustrates an OSD menu comprising a functional item for avoiding eye and bodily injury from using a display device.

FIG. 2 schematically illustrates an OSD menu comprising a functional item for avoiding eye and bodily injury from using a display device. The OSD menu 1 comprises a plurality of function control targets such as horizontal size, vertical size, horizontal-position, vertical-position, etc. The function control target with an eye symbol (labeled 2) represents an eyesaver application program comprising the first and second programs for implementing the present invention. When the eye symbol 2 is activated, an eyesaver settings menu 3, such as that shown in FIG. 3, is displayed.

Figure 3:
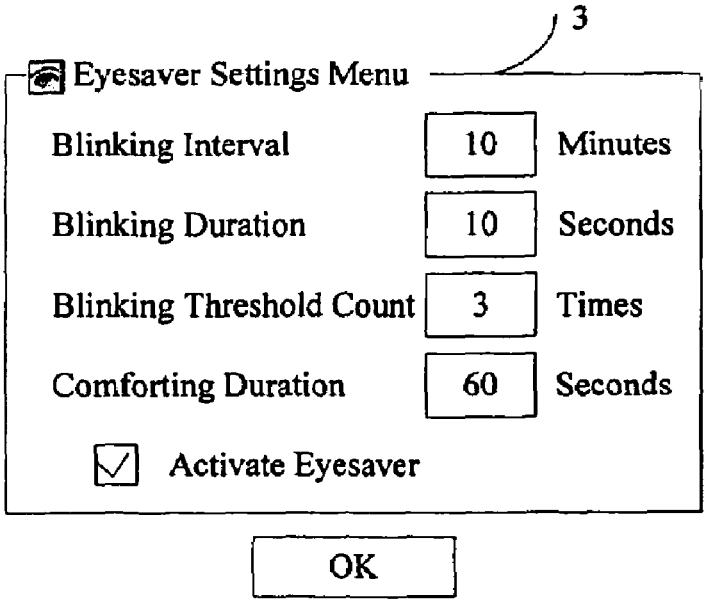
FIG. 3 schematically illustrates an eyesaver settings menu according to the present invention.

FIG. 3 schematically illustrates an eyesaver settings menu according to the present invention. The eyesaver settings menu 3 comprises a plurality of parameters and preset threshold values thereof, and a check box for activating the eyesaver application program if necessary. The parameters comprise a blinking interval, a blinking duration, a blinking threshold count, and a comforting duration. The blinking interval is a waiting time for running the first program again. The blinking duration is a preset running time of the first program. The blinking threshold count is a running count of successively running the first program. The comforting duration is a preset running time of the second program. The value of each parameter has a default setting, such as that shown in FIG. 3. In addition, the value of each parameter can be changed according to the user's requirements, with the changed parameters being stored in the OSD component 12. In the preferred embodiment of the present invention, the values of the parameters are all default settings.

Figure 4:
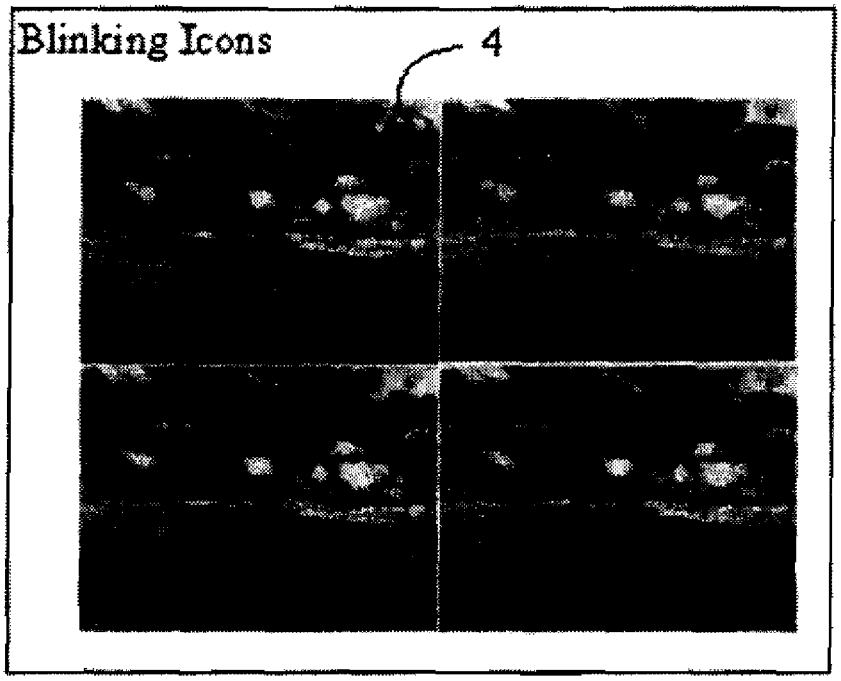
FIG. 4 schematically illustrates a series of four blinking icons which are shown one after the other on a screen of the display device.

FIG. 4 schematically illustrates a series of four blinking icons which are shown one after the other on a screen of the displaying unit 16, the blinking icons functioning to remind a user to blink. When a waiting time for running the first program reaches a preset threshold value of the blinking interval, the first program stored in the storage unit 101 is run. Thereupon the blinking icon (labeled 4 in the first screen display of FIG. 4) is displayed in a top right corner of the screen of the displaying unit 16. The blinking icon changes dynamically so as to simulate blinking actions of a user, as shown in the second through fourth screen displays of FIG. 4. The blinking actions can be any suitable actions such as eye blinking, eye closing, eye opening, and the like. Through the blinking icons, the user is reminded to do various blinking actions to relieve his/her eyes from tiredness. In addition, once the running time of the first program reaches a preset threshold value of the blinking duration, the blinking icons can be automatically hidden. Further or alternatively, the blinking icons can be also manually hidden, by way of the user operating the keypad unit 11 to input an appropriate command. The blinking icons are a series of eye symbols comprising an eye blinking symbol, an eyeball rotation symbol, an eye closing symbol, an eye opening symbol, and the like. Here, it must be notified that any other type of dynamic icons, which are operated in a similar manner and remind the user to relieve his/her eyes from tiredness, should be made to the present invention without departing from the spirit of the present invention.

Figure 5:
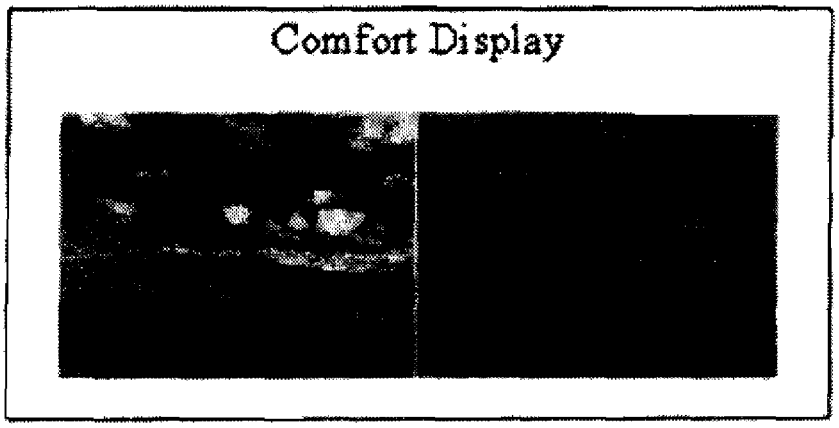
FIG. 5 schematically illustrates a first and a last of a series of successive screen displays.

FIG. 5 schematically illustrates a first and a last of a series of successive screen displays of the displaying unit 16, the last screen display being a comfort display, the comfort display functioning to remind a user to take exercises. When the running count of successively running the first program reaches a preset threshold value of the blinking threshold count, the second program stored in the storage unit 101 runs. Thereupon, the screen in a normal mode (such as that shown in the first screen display of FIG. 5) gradually changes to a faint mode (such as the last screen display of FIG. 5). The last screen display in the faint mode is called the comfort display. The comfort display is used for reminding the user to pause from working on the computer, and to take some exercises, such as eye exercises, wrist exercises, neck exercises, waist exercises, and the like. These exercises should be of the kind for preventing repetitive stress injuries. When the running time of the second program reaches a preset threshold value of the comforting duration, the screen is automatically switched to the normal mode. That is, the second program has finished. Alternatively, the user can manually stop displaying the comfort display. The user operates the keypad unit 11 to input an appropriate command, whereupon the screen is switched to the normal mode. Here, it must be notified that any other type of modes, which are operated in a similar manner and remind the user to relieve his/her bodies from tiredness, should be made to the present invention without departing from the spirit of the present invention.

Figure 6:
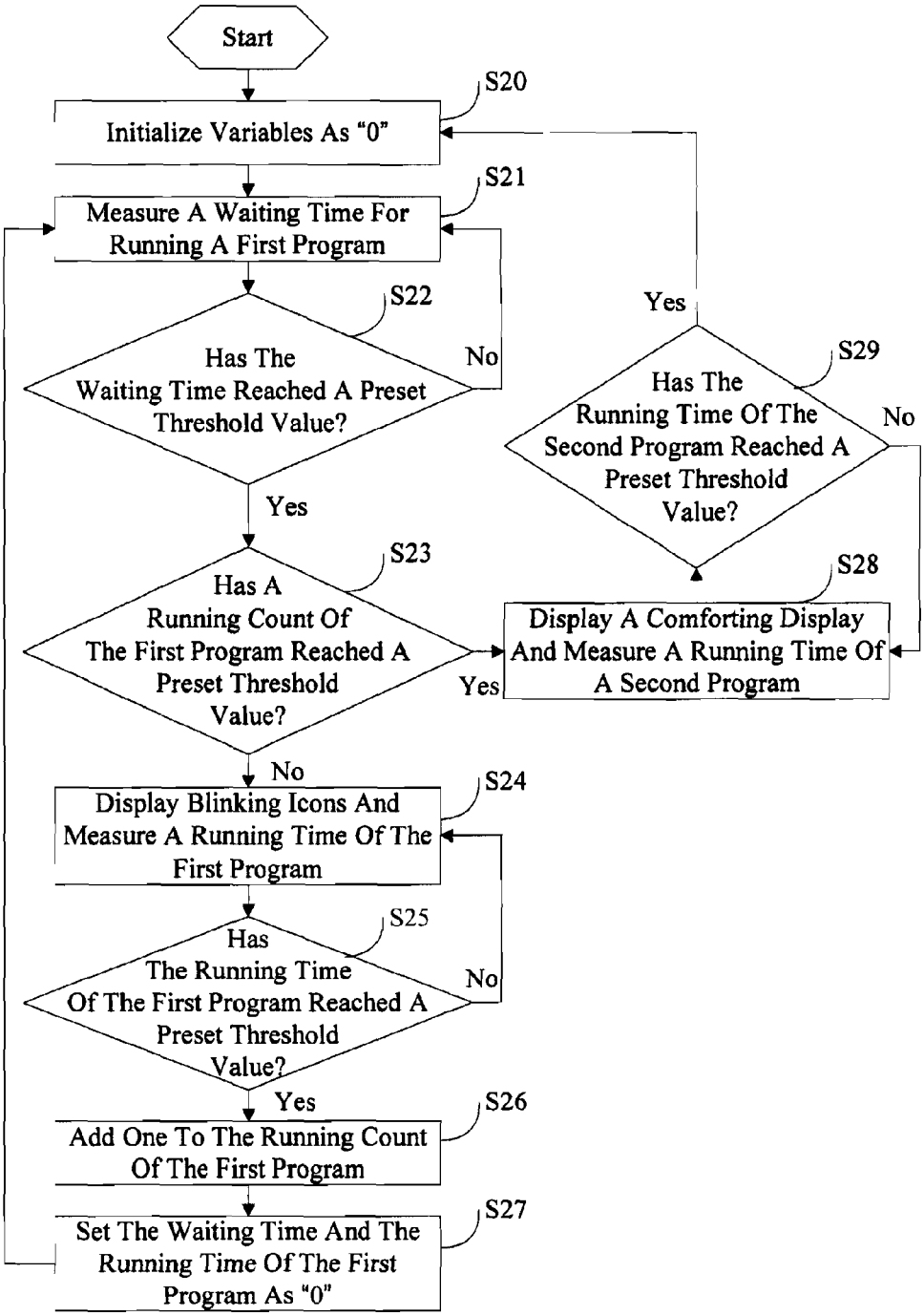
FIG. 6 is a flowchart of a preferred method for avoiding eye and bodily injury from using a display device, in accordance with the present invention.

FIG. 6 is a flowchart of a preferred method for avoiding eye and bodily injury from using a display device, in accordance with the present invention. In step S20, the control unit 100 detects that video signals are output from the displaying unit 16, and initializes a plurality of variables as "0." The variables comprise a waiting time for running the first program, a running time and a running count of the first program, and a running time of the second program. In step S21, the timer 102 measures the waiting time for running the first program. In step S22, the control unit 100 determines whether the waiting time for running the first program has reached a preset threshold value of the blinking interval. If the waiting time for running the first program has not reached the preset threshold value of the blinking interval, the procedure returns to step S21 described above.

If and when the waiting time for running the first program has reached the preset threshold value of the blinking interval, in step S23, the control unit 100 determines whether the running count of the first program has reached a preset threshold value of the blinking threshold count. If the running count of the first program has reached the preset threshold value of the blinking threshold count, the procedure goes to step S28 described below.

In contrast, if the running count of the first program has not reached the preset threshold value of the blinking threshold count, in step S24, the displaying unit 16 runs the first program to display the blinking icons, and the timer 102 measures the running time of the first program. Then in step S25, the control unit 100 determines whether the running time of the first program has reached a preset threshold value of the blinking duration. If the running time of the first program has not reached the preset threshold value of the blinking duration, the procedure returns to step S24 described above. If and when the running time of the first program has reached the preset threshold value of the blinking duration, in step S26, the counter 103 adds one to the running count of the first program. Then in step S27, the control unit 100 resets the waiting time for running the first program and the running time of the first program as "0," and the procedure returns to step S21 described above.

In step S28, the displaying unit 16 runs the second program to display a comfort display reminding a user to take exercises, and the timer 102 measures the running time of the second program. Then in step S29, the control unit 100 determines whether the running time of the second program has reached a preset threshold value of the comforting duration. If the running time of the second program has not reached the preset threshold value of the comforting duration, the procedure goes back to step S28 described above. If and when the running time of the second program has reached the preset threshold value of the comforting duration, the procedure goes back to step S20 described above.

Although the present invention has been specifically described on the basis of a preferred embodiment and preferred method, the invention is not to be construed as being limited thereto. Various changes or modifications may be made to the embodiment and method without departing from the scope and spirit of the invention.

We claim:

1. A system for avoiding eye and bodily injury from using a display device, the system comprising a control unit, a storage unit, a timer, a counter, an on screen display (OSD) component, and a displaying unit, wherein:

the storage unit is for storing a first program and a second program;

the timer is for measuring a waiting time for running the first program, and further for respectively measuring corresponding running times of the first and second programs, wherein the waiting time is measured when the display device outputs video signals;

the counter is for counting a running count for successively running the first program;

the control unit is for running the first program and outputting control signals when the waiting time reaches a first preset threshold value, and for running the second program when the running count reaches a second preset threshold value and outputting control signals;

the OSD component is for receiving the control signals, and outputting OSD data; and the display unit is for displaying the OSD data in a first and a second modes corresponding to the first and second programs.

2. The system according to claim 1, further comprising a keypad unit for sending control signals to the control unit in response to operations of users.

3. The system according to claim 1, wherein the first mode is displaying the OSD data as dynamic icons for reminding a user to relax his/her eyes.

4. The system according to claim 3, wherein the dynamic icons are a series of eye symbols comprising an eye blinking symbol, an eyeball rotation symbol, an eye closing symbol, and an eye opening symbol.

5. The system according to claim 3, wherein dynamics of the icons comprise moving upwards, downwards, leftwards or rightwards, zooming in or out gradually and changing illumination of the icons.

6. The system according to claim 1, wherein the first mode is finished when the running time of the first program has reached a third preset threshold value.

7. The system according to claim 1, wherein the second mode is a comfort display obtained by switched gradually from a normal mode of a screen of the display device to a faint mode.

8. The system according to claim 1, wherein the second mode is a dynamic icon.

9. The system according to claim 1, wherein the second mode is displayed when the running count of the first program has reached the second preset threshold value.

10. The system according to claim 1, wherein the second mode is finished when the running time of the second program has reached a fourth preset threshold value.

11. A method for avoiding eye and bodily injury from using a display device, comprising the steps of:

(a) presetting a value of an interval and a number;

(b) setting a waiting time for running a first program, a running time and a running count of the first program, and a running time of a second program as "0;"

(c) measuring the waiting time;

(d) if the waiting time has reached a first preset threshold value of the interval, running the first program to display a series of dynamic icons for reminding a user to relax his/her eyes;

(e) after the first program has finished, increasing the running count once;

(f) if the running count has not reached a second preset threshold value of the number, going to step (c), otherwise, running the second program to display a mode for reminding the user to relax his/her body; and (g) after the second program has finished, going back to step (b) if or as required.

12. The method according to claim 11, wherein in said step (d), the dynamic icons are one kind of a series of eye symbols comprising an eye blinking symbol, an eyeball rotation symbol, an eye closing symbol, or an eye opening symbol, and a series of pictures.

13. The method according to claim 12, wherein movement of the symbols and the pictures comprises moving upwards, downwards, leftwards or rightwards, or zooming in or out gradually.

14. The method according to claim 11, wherein in said step (d), illumination of said dynamic icons is changeable.

15. The method according to claim 11, wherein the dynamic icons disappear when the running time of the first program has reached a third preset threshold value.

16. The method according to claim 11, wherein in said step (f), the mode is a comfort display obtained by switched gradually from a normal mode of a screen of the display device to a faint mode.

17. The method according to claim 11, wherein in said step (f), the mode is set as a dynamic icon or changeable illumination.

18. The method according to claim 11, wherein the mode is finished when the running time of the second program has reached a fourth preset threshold value.

19. A method for avoiding ocular injury and bodily injury from long-termed use of a display device, comprising the steps of:

providing a first program running as a reminder of performing relief from said ocular injury;

providing a second program running as a reminder of performing relief from said bodily injury;

running said first program for a first duration after an operating time of said display device meets a preset value;

repeating said running of said first program; and running automatically said second program for a second duration in case that said repeating of said running of said first program meets a preset condition.

20. The method according to claim 19, wherein said preset value, said first and second duration and said preset condition are manually settable via an on screen display (OSD) menu of said display device.

* * * * *